US007051719B1

(12) United States Patent
Sengoku et al.

(10) Patent No.: US 7,051,719 B1
(45) Date of Patent: May 30, 2006

(54) COMBUSTION ENHANCEMENT DEVICE

(76) Inventors: Seiichi Sengoku, 6-20 Kurekawa Chou, Ashiya City, Hyougo (JP) 659-0051; Tohru Uchida, 1-11-8 Kamitsuchii, Gifu City, Gifu (JP) 502-0803

( * ) Notice: Subject to any disclaimer, the term of this patent is extended or adjusted under 35 U.S.C. 154(b) by 0 days.

(21) Appl. No.: 11/027,459

(22) Filed: Dec. 29, 2004

(51) Int. Cl.
*F02B 51/00* (2006.01)

(52) U.S. Cl. ..... 123/536; 123/539

(58) Field of Classification Search ..... 123/536–539
See application file for complete search history.

(56) References Cited

U.S. PATENT DOCUMENTS 3,678,908 A 7/1972 Ito
5,111,797 A * 5/1992 Shikanai ..... 123/539
5,941,219 A * 8/1999 Takebe ..... 123/536
6,536,418 B1 3/2003 Ling
6,653,646 B1 * 11/2003 Shibata ..... 250/497.1
6,743,271 B1 6/2004 Takimoto
2004/0031254 A1 2/2004 Takimoto

* cited by examiner

*Primary Examiner*—Marguerite McMahon
(74) *Attorney, Agent, or Firm*—Starkweather & Associates; Michael W. Starkweather; Jason P. Webb

(57) ABSTRACT

A combustion enhancement device for internal combustion engines using alpha and/or beta particles to add ions to air intake thereby facilitating complete combustion. There is a base material with holes. Tabs form the walls of the holes or channels. On the base material and tabs there is a substance emitting alpha and/or beta particles. The substance also includes a bonding matrix material. The holes are configured to enhance exposure to high densities of alpha and/or beta particles. Engine performance purity and power may be significantly increased despite a possible impact of the device on air flux into the air intake.

20 Claims, 4 Drawing Sheets

COMBUSTION ENHANCEMENT DEVICE

BACKGROUND OF THE INVENTION

1. Field of the Invention

The present invention relates to combustion enhancement devices and methods, specifically to combustion enhancement devices for internal combustion engines.

2. Description of the Related Art

In internal combustion engines, air is mixed with fuel and then ignited in a combustion chamber. The resultant gas includes diverse pollutants such as carbon monoxide, hydrocarbons, and nitrogen oxides. Incomplete combustion is linked to pollutants in the resultant gas, both as a cause and a symptom. Incomplete combustion also decreases the efficiency and power of the internal combustion engine.

Typically, air fed into internal combustion engines is not in a state to facilitate ideal combustion. Ideally, air to be used in an internal combustion engine would have a balance of positive and negative ions. However, the air generally fed into internal combustion engines will have an overabundance of positive ions which interfere during the combustion process and cause incomplete combustion.

Negative ions may be added to air by exposing the air to alpha and/or beta particles. However, the negative ions do not continue to exist for very long, so the air must be mixed with fuel and combusted fairly quickly after being exposed to the alpha and/or beta particles. Therefore the source of the alpha and/or beta particles must be sufficiently close to the point of mixture of the fuel and the air. Further the air must be sufficiently exposed to the source of the alpha and/or beta particles.

One natural source of alpha and/or beta particles is natural ore containing rare earth metals. This ore may be ground into particles or a powder and affixed to surfaces. The surfaces may then be adapted for and affixed to or adjacent to internal combustion engines. These surfaces, attached to the internal combustion engine, are combustion enhancement devices. Negative ions may then be added to air by the combustion enhancement devices.

"Activating the air" by adding negative ions requires exposure to the source of alpha and/or beta particles. Because of the special demands of internal combustion engines, the nature of the air, and the short life of the negative ions, appropriate exposure of the alpha and/or beta particles becomes difficult. Several, sometimes conflicting, requirements are presented.

Since the negative ions only exist for a short time, the particle source needs to be close, in time, to the moment of the mixing of the fuel and air. Typically this means it must be a part of the air intake system of the internal combustion engine. Therefore a combustion enhancement device must have some way to couple to or be installed within the air intake system of a combustion enhancement device. This presents some difficulty as different internal combustion devices have differently configured air intake systems. Therefore one combustion enhancement device may work well for one engine type, but may be difficult or impossible to install on another.

Additionally, to activate the air, there must be sufficient exposure of the air to the particle source. However, a typical internal combustion engine requires a high air flow. This requirement adds difficulty where the combustion enhancement device is required to expose a significant portion of the air to the alpha and/or beta particles while at the same time not significantly restricting the air flow required by the internal combustion engine.

More, the demands of the marketplace require that all these conflicting requirements be satisfied in an inexpensive device which is easily installed on a variety of internal combustion engines.

What is needed is a combustion enhancement device to enhance the purity, power and performance of an internal combustion engine while satisfying one or more of the above requirements.

Incorporated by reference herein is Japanese utility model U3082307 "Combustion Improvement through Effective Equipment" to Seiichi Sengoku.

SUMMARY OF THE INVENTION

The present invention has been developed in response to the present state of the art, and in particular, in response to the problems and needs in the art that have not yet been fully solved by currently available combustion enhancement devices. Accordingly, the present invention has been developed to provide a combustion enhancement device for internal combustion engines.

Disclosed is a device to enhance combustion of internal combustion engines. The device includes a base material, being substantially rigid to withstand the forces present near air intakes of internal combustion engines, especially high speed air flow. The base material preferably is aluminum. There is a base material plane defined by the major planar orientation of the base material. The base material has a first side comprising a first plane defined by the major planar orientation of the first side and a second side comprising a second plane defined by the major planar orientation of the second side. Preferably the base material is a flat and generally rectangular sheet of aluminum.

There are a plurality of holes disposed in the base material through first plane and the second plane. Preferably, each hole is square shaped and preferably a total area of the holes in the plane of the base material is less than 55 percent of a total area of the plane of the base material as defined by multiplying a length of the base material by a width of the base material wherein the length and width of the base material are both substantially parallel to the base material plane. Preferably, each of the plurality of square-shaped holes has a hole length ranging between about 10 millimeters and 25 millimeters and preferably a distance between edges of each adjacent square-shaped hole ranges between about 2 millimeters and 3 millimeters. There are a plurality of tabs on the first side and extending therefrom, adjacent to each hole and substantially perpendicular to the base material plane. Preferably, each tab is triangle shaped and is preferably made from the same material as the base material.

Each tab has an inner surface wherein the inner surface is generally directed towards a center of a corresponding hole. Each tab also has an outer surface wherein the outer surface is generally directed away from the center of the corresponding hole. Each tab also includes a substance disposed on the second side of the base material and the inner surface of each tab but preferably not disposed near the edge of each of the plurality of tabs.

The substance comprises a source of particles wherein the particles are selected from the group consisting of alpha particles and beta particles. Preferably the source of particles comprises a source material selected from the group consisting of rare earth metals and rare earth ore. Included in the substance is a bonding matrix material which helps bond the source material to the base material and may provide a matrix wherein the source material may reside. Preferably the bonding matrix material comprises a paint material selected from the group consisting of mineral paint, organic/inorganic compound paint, luminous paint, conductive paint and magnetic paint.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
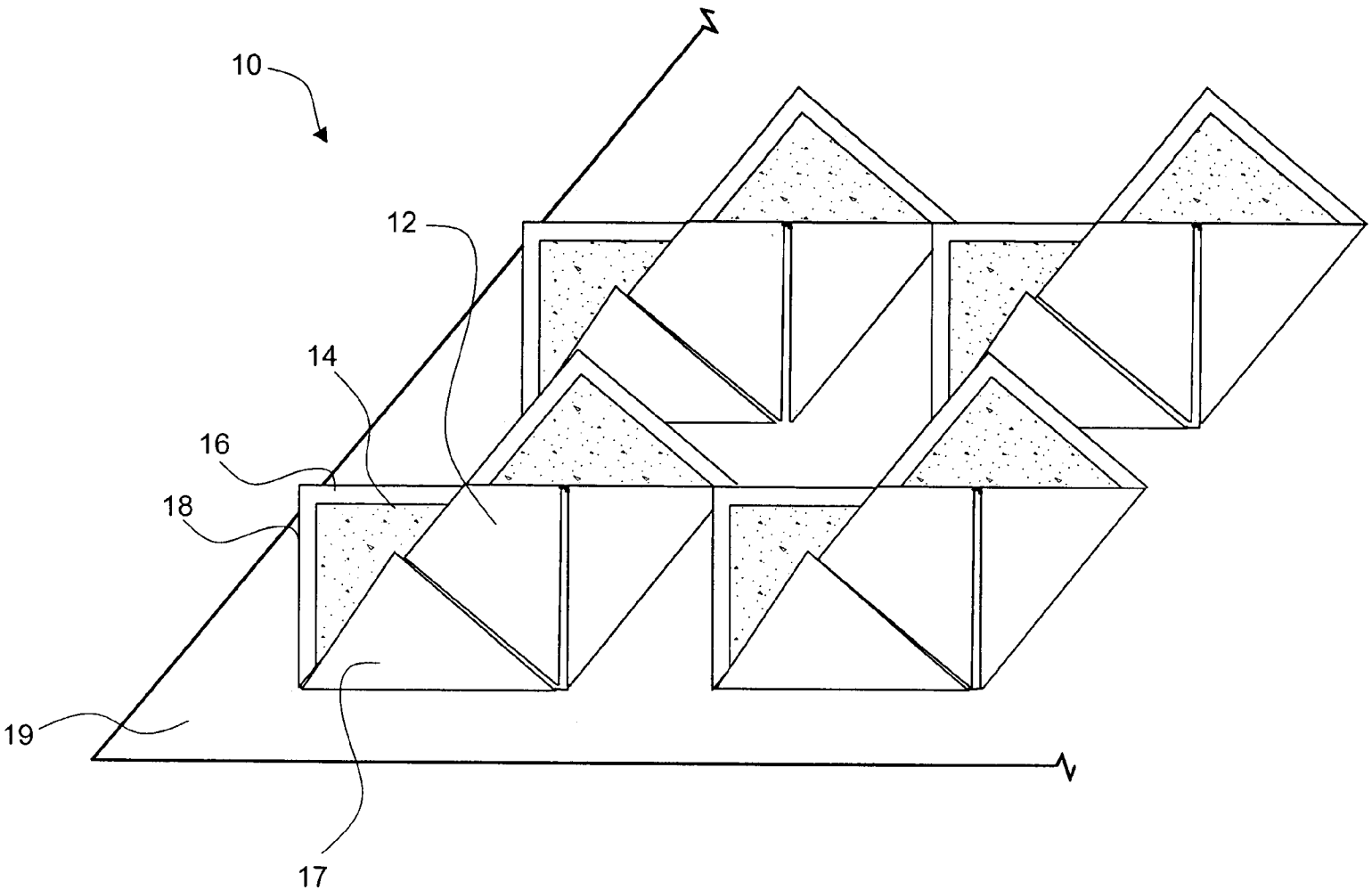
FIG. 1 illustrates a perspective view of a portion of a combustion enhancement device according to one embodiment of the invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

FIG. 1 illustrates a perspective view of a portion of a combustion enhancement device 10 according to one embodiment of the invention. The combustion enhancement device portion 10 comprises a base material 19, being substantially rigid and including a base material plane defined by the major planar orientation of the base material, a first side having a first plane defined by the major planar orientation of the first side and a second side having a second plane defined by the major planar orientation of the second side. The combustion enhancement device portion 10 further includes a plurality of holes 12 disposed in the base material 19 through the first plane and the second plane.

Adjacent to each hole and substantially perpendicular to the base material plane 19 is a plurality of tabs 18 on the first side of the base material 19 and extending therefrom. Each tab 18 includes an inner surface 16 wherein the inner surface 16 is generally directed towards a center of a corresponding hole 12 and an outer surface 17 wherein the outer surface 17 is generally directed away from the center of the corresponding hole 12 and a substance 14 disposed on the second side of the base material 19 and the inner surface 16 of each tab 18 wherein the substance 14 comprises a source of particles wherein the particles are selected from the group consisting of alpha particles and beta particles.

In operation, the combustion enhancement device 10 is located in the path of air flow which is to be used for combustion within an internal combustion engine. Preferably, the combustion enhancement device 10 is attached to an air intake portion of the internal combustion engine (see FIG. 3). Also preferably, the combustion enhancement device is placed such that the air flow must pass through the holes 12 of the combustion enhancement device 10 and the second side of the sheet 19 having the substance thereupon faces the direction of the air flow.

Advantageously the combustion enhancement device does not need to be integrated within the air intake system of the combustion engine, but may be attached thereon the surface. Preferably the combustion enhancement device may be attached simply with clips, thereby not requiring significant alteration of the air intake system. Further advantageously, the combustion enhancement device 10 may be easily installed on a variety of internal combustion engines having a variety of air intake systems because the combustion enhancement device 10 may be relatively light, thin, and modular. As the air flows through the holes 12, alpha and/or beta particles emitted from the substance 14 interact with the air and add ions to the air. The air may then be subsequently combusted together with fuel inside the internal combustion engine, wherein the added ions contribute to more complete combustion, resulting in enhanced power, enhanced purity of the resultant gasses and enhanced performance of the internal combustion engine.

Figure 2:
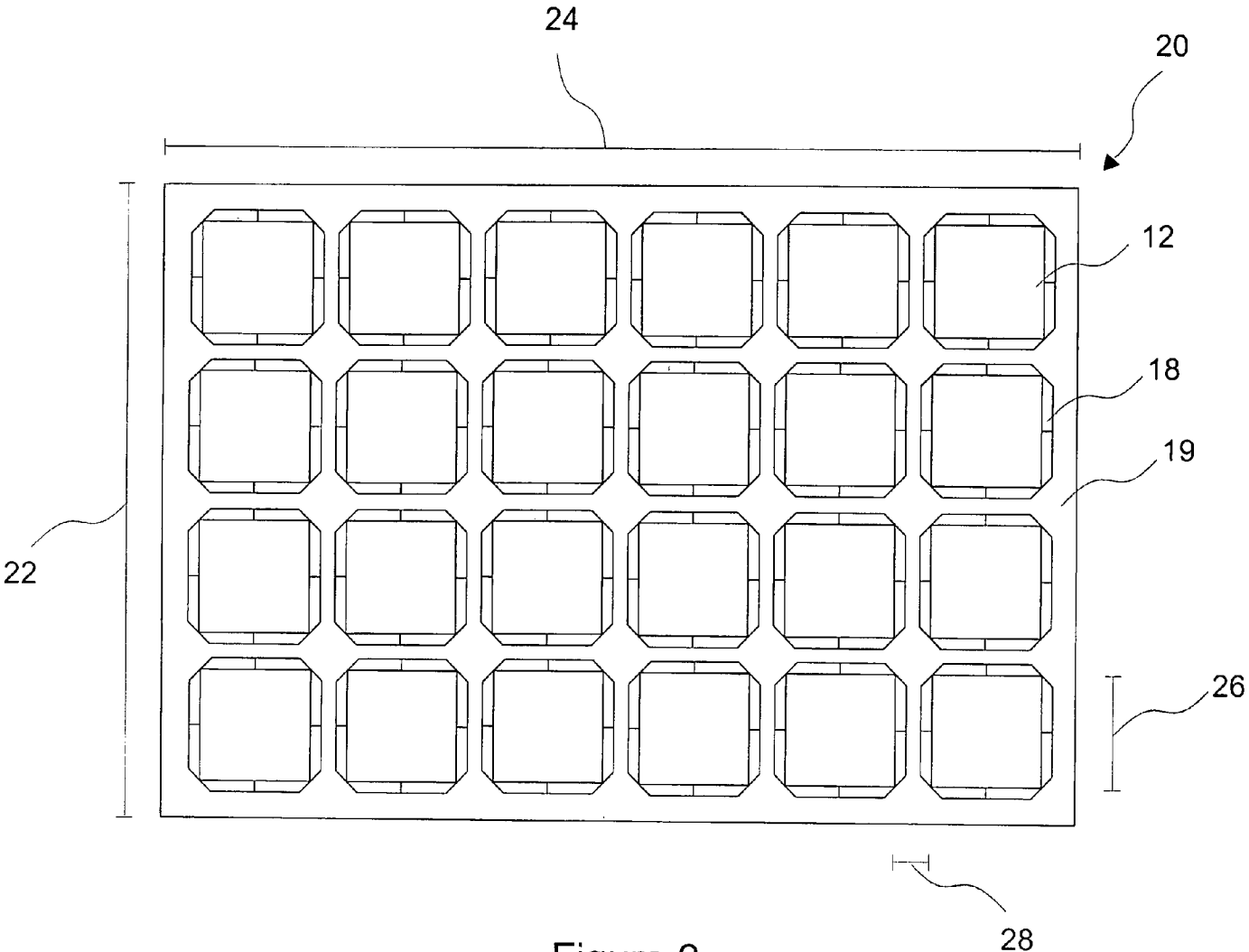
FIG. 2 illustrates a top view of a combustion enhancement device according to one embodiment of the invention.

FIG. 2 illustrates a top view of a combustion enhancement device 20 according to one embodiment of the invention. The combustion enhancement device 20 includes a base material 19, a plurality of holes 12 disposed in the base material 19 and a plurality of tabs 18 adjacent to each hole 12. The combustion enhancement device further includes a length 22, a width 24, a hole length 26 and a distance between the edges of each adjacent hole 28. Additionally, the mathematical square of the hole length 26 multiplied by the total number of plurality of holes 12 defines a total area of the holes 12, which total area of the holes is preferably less than 60 percent of a total area of the plane of the base material 19 as defined by multiplying the length 22 and width 24 of the base material 19.

A combustion enhancement device 20 of this configuration necessarily has some effect on air flow by increasing, at least minimally, the resistance of air flow into an air intake system because the portions of the combustion enhancement device between adjacent holes 12 may block air flow. However, even where the combustion enhancement device 20 may have a significant effect on air flow into an internal combustion engine, the beneficial effects of the combustion enhancement device 20 may far outweigh negative effects on conventional air flow requirements of internal combustion engines. For example, even where the total area of the holes 12 of the combustion enhancement device 20 is less than 60% of the total area of the combustion enhancement device 20, the device 20 may still substantially enhance the power, purity, and performance of the internal combustion engine.

Figures 3A, 3B:
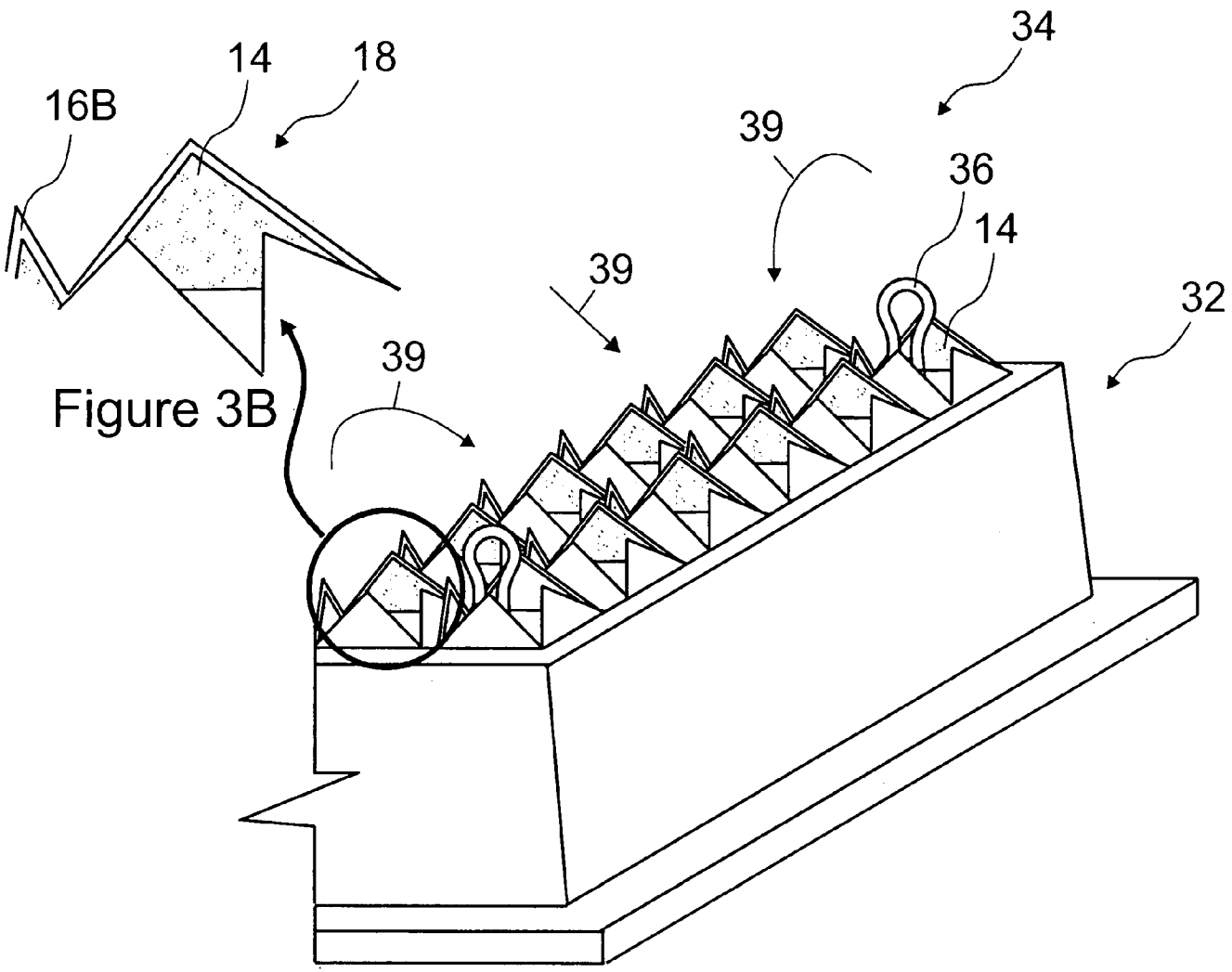
FIGS. 3A and 3B illustrate a perspective view of a pair of combustion enhancement device coupled to an air filter according to one embodiment of the invention and a close up view of a group of tabs according to one embodiment of the invention.

FIGS. 3A and 3B illustrate a perspective view of a portion of a combustion enhancement device 34 coupled to a portion of an air filter 32 according to one embodiment of the invention, preferably by omega clips 36 and a close up view of a group of tabs 18 according to one embodiment of the invention. The combustion enhancement device 34 exposes air flow 39 of the air filter 32 to alpha and/or beta particles.

The combustion enhancement device 34 covers the air filter 32 and provides holes, or channels 12 (See FIG. 1) wherein air intake 39 flows into and through the air filter 32. The pins 36 securely couple the combustion enhancement device 34 to the air filter 32 such that the air flow 39 must substantially flow through at least one of holes 12 in the combustion enhancement device 34. Therefore, advantageously the combustion enhancement device 34 may first process the air intake 39 before it is combusted. Where the area covered by the combustion enhancement device 34 is insufficient to substantially completely cover the air filter 32, additional combustion enhancement devices 34 may be coupled to the air filter 32.

Additionally, FIG. 3A illustrates a substance 14 coating inner sides 16 (see FIG. 1) of tabs 18. Notably, the substance 14 as illustrated does not completely cover the full surface of the inner side 16 of each tab 18. There may be a border region 16*b* free of substance 14. Advantageously, this border region 16*b* may facilitate efficient manufacture of the combustion enhancement device 34 wherein during the formation of the tabs 18, by cutting or scoring the flat base material 19 (see FIG. 1) for example, the machinery is not required to come in substantial contact with the substance 14 during cutting or scoring of the base material 19. This may be particularly valuable where the substance 14 comprises an abrasive material such as ground ore. Thus wear and tear on the manufacturing machinery may be significantly reduced. Further, less substance 14 is lost to waste.

Figure 4:
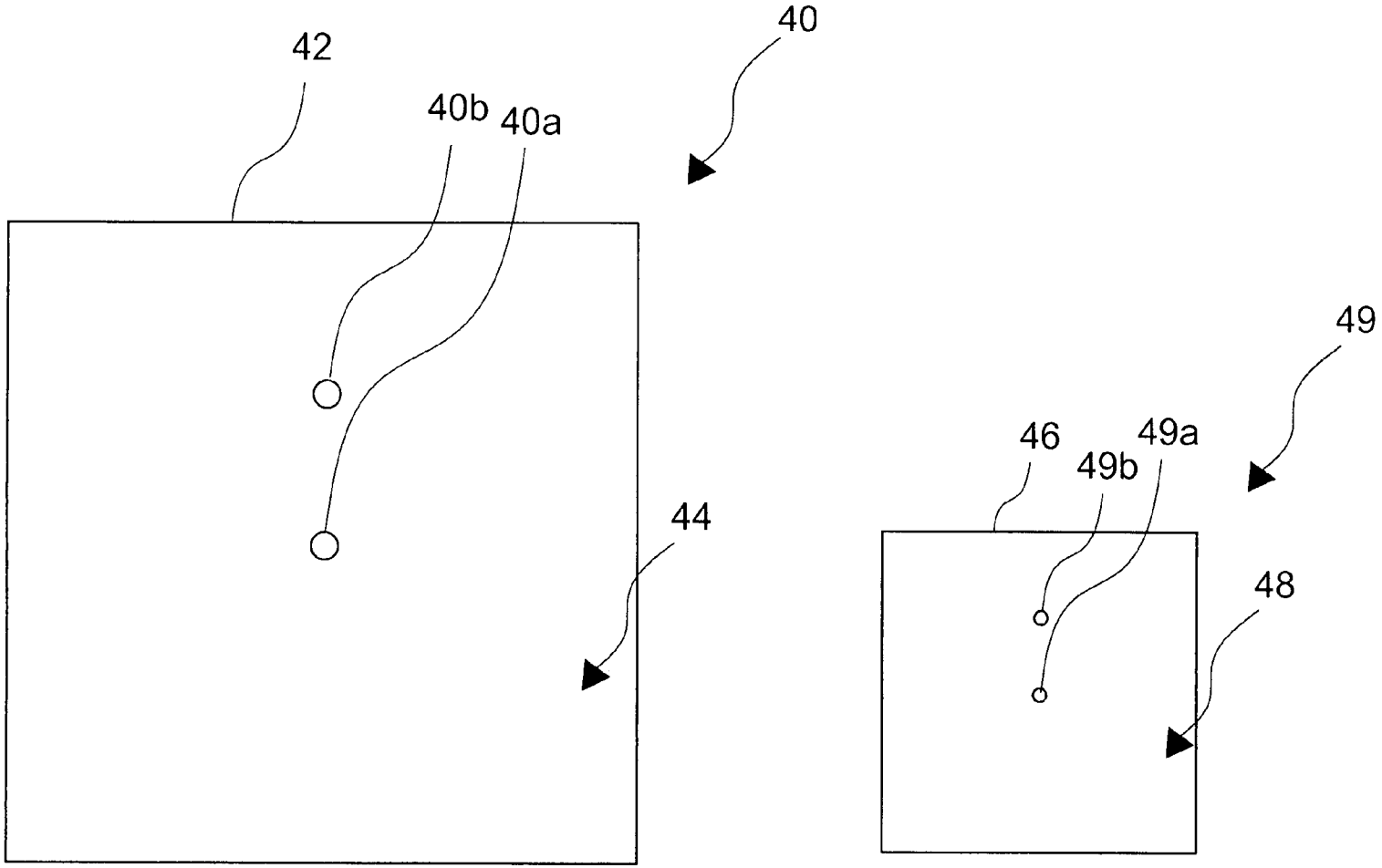
FIG. 4 illustrates generalized comparative particle flux densities for two sizes of square-shaped regions according to one embodiment of the invention.

FIG. 4 illustrates generalized comparative particle flux densities for two sizes of square-shaped regions according to one embodiment of the invention. Shown is a first square 40 and a second square 49 comprising a first square length 42 and a second square length 46 respectively wherein the second square length 46 measures half the first square length 42. Further, the first square 40 and second square 49 comprise a first internal region 44 and a second internal region 48 respectively. Defined within the first square 40 and the second square 49 respectively is a first center 40*a* and a second center 49*a* wherein the first center 40*a* and the second center 49*a* each mark the central point of each respective square.

Further defined in the first square 40 and the second square 49 are measurement points 40*b* and 49*b*, wherein each measurement point 40*b* and 49*b* is disposed halfway between the length 42 and 46 of each respective square 40 and 49 and each respective center 40*a* and 49*a*. Therefore, where the first square length 42 and the second square length 46 are each sources of identical flux densities of particles, such as alpha and/or beta particles, a particle flux density measurement of one unit at the first center 40*a* would correspond to a particle flux density measurement of approximately eight units at measurement point 40*b* and second center 49*a* and a measurement of approximately sixty-four units at measurement point 49*b*. Therefore, exposure of air intake 39 (See FIG. 3) through a hole or channel 12 (See FIG. 1) in a combustion enhancement device 20 (See FIG. 2) comprising tabs 18 (See FIG. 1) with inner surfaces 16 (See FIG. 1) with a source of alpha and/or beta particles 14 (See FIG. 1) disposed thereon, is significantly increased on the order of a multiple of eight times when the length of each hole is halved. Therefore, even when the combustion enhancement device begins to adversely restrict the air intake 39 to an internal combustion engine (not shown), overall combustion efficiency and power may still be enhanced despite restricted air intake because of the exponential increase in flux density.

It is understood that the above-described preferred embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

For example, although the tabs are shown to be triangular, it is envisioned that the tabs may be of any shape, including but not limited to rectangles, squares, partial circles, and irregularly shaped. Further, while the tabs are illustrated as being substantially identical in shape and size, it is envisioned that the tabs may differ, on from another, in shape and/or size. Further, while the holes or channels are illustrated as square shaped, it is envisioned that they may be of any shape including but not limited to circular, triangular, polygonal and irregular shaped. Still further, while the holes or channels are illustrated as substantially identical in size and shape, it is envisioned that they may be of differing shape and/or size, on from another.

Additionally, although the figures illustrate a substantially planar rectangular combustion enhancement device, it is envisioned that the combustion enhancement device may be formed in many different configurations including but not limited to rings, cylinders, polygons, arrays, spheres, layers and irregular shapes. Further, it is envisioned that the combustion enhancement devices may be configured to interlock. Also, it is envisioned that the combustion enhancement device may be configured to couple to all known air intakes of internal combustion engines.

Finally, it is envisioned that the components of the device may be constructed of a variety of materials, including but not limited to aluminum, resin, composite, plastic, metal alloys and fabric.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A device to enhance combustion of internal combustion engines, comprising:

a base material, being substantially rigid and including:

a base material plane defined by the major planar orientation of the base material;

a first side comprising a first plane defined by the major planar orientation of the first side and a second side comprising a second plane defined by the major planar orientation of the second side;

a plurality of holes disposed in the base material through first plane and the second plane, wherein a total area of the holes in the plane of the base material is less than 60 percent of a total area of the base material;

a plurality of tabs extending from the first side, adjacent to each hole and substantially perpendicular to the base material plane, wherein each tab includes:

an inner surface wherein the inner surface is generally directed towards a center of a corresponding hole; and an outer surface wherein the outer surface is generally directed away from the center of the corresponding hole; and a substance disposed on the second side of the base material and the inner surface of each tab wherein the substance comprises a source of particles wherein the particles are selected from the group consisting of alpha particles and beta particles.

2. The device of claim 1, wherein the substance further comprises a bonding matrix material.

3. The device of claim 1, wherein the source of particles comprises a source material selected from the group consisting of rare earth metals and rare earth ore.

4. The device of claim 1, wherein the base material comprises a material selected from the group consisting of metal, resin, ceramic and composite.

5. The device of claim 2, wherein the bonding matrix material comprises a paint material selected from the group consisting of mineral paint, organic/inorganic compound paint, luminous paint, conductive paint and magnetic paint.

6. The device of claim 1, wherein the total area of the holes in the plane of the base material is less than about 55 percent of the total area of the plane of the base material as defined by multiplying a length of the base material by a width of the base material wherein the length and width of the base material are both substantially parallel to the base material plane.

7. The device of claim 1, wherein total area of at least one of the plurality of holes is less than about 144 square millimeters.

8. The device of claim 1, wherein there is a border region along the edges of the tabs wherein the substance is not disposed near edges of the tabs.

9. The device of claim 1, wherein the each of the plurality of tabs is triangle-shaped and each of the plurality of holes is square-shaped.

10. The device of claim 9 wherein each of the plurality of square-shaped holes has a hole length ranging between about 10 millimeters and 25 millimeters and a distance between edges of each adjacent square-shaped hole ranges between about 2 millimeters and 3 millimeters.

11. A device to enhance combustion of internal combustion engines, comprising:

a base material, being substantially rigid and including:

a base material plane defined by the major planar orientation of the base material;

a first side comprising a first plane defined by the major planar orientation of the first side and a second side comprising a second plane defined by the major planar orientation of the second side;

a plurality of holes disposed in the base material through first plane and the second plane, wherein a total area of the holes in the plane of the base material is less than 60 percent of a total area of the plane of the base material as defined by multiplying a length of the base material by a width of the base material wherein the length and width of the base material are both substantially parallel to the base material plane;

a plurality of tabs on the first side and extending therefrom, adjacent to each hole and substantially perpendicular to the base material plane, wherein each tab includes:

an inner surface wherein the inner surface is generally directed towards a center of a corresponding hole; and an outer surface wherein the outer surface is generally directed away from the center of the corresponding hole; and a substance disposed on the second side of the base material and the inner surface of each tab wherein the substance comprises:

a source of particles wherein the particles are selected from the group consisting of alpha particles and beta particles; and a bonding matrix material.

12. The device of claim 11, wherein the base material comprises a base material material selected from the group consisting of metal, resin, ceramic and composite.

13. The device of claim 12, wherein the bonding matrix material comprises a paint material selected from the group consisting of mineral paint, organic/inorganic compound paint, luminous paint, conductive paint and magnetic paint.

14. The device of claim 13, wherein the source of particles comprises a source material selected from the group consisting of rare earth metals and rare earth ore.

15. The device of claim 14, wherein the substance is not disposed near edges of the tabs.

16. The device of claim 15, wherein the total area of the holes in the plane of the base material is less than about 55 percent of the total area of the plane of the base material as defined by multiplying a length of the base material by a width of the base material wherein the length and width of the base material are both substantially parallel to the base material plane.

17. The device of claim 16, wherein each of the plurality of tabs is triangle-shaped and each of the plurality of holes is square-shaped.

18. The device of claim 17, wherein each of the plurality of square-shaped holes comprises a hole length ranging between about 10 millimeters and 25 millimeters and a distance between edges of each adjacent square-shaped hole ranging between about 2 millimeters and 3 millimeters.

19. The device of claim 18, wherein the base material is aluminum.

20. A device to enhance combustion of internal combustion engines, comprising:

a base material, being substantially rigid, comprising aluminum and including:

a base material plane defined by the major planar orientation of the base material;

a first side comprising a first plane defined by the major planar orientation of the first side and a second side comprising a second plane defined by the major planar orientation of the second side;

a plurality of holes disposed in the base material through first plane and the second plane, wherein each hole is square shaped and a total area of the holes in the plane of the base material is less than 55 percent of a total area of the plane of the base material as defined by multiplying a length of the base material by a width of the base material wherein the length and width of the base material are both substantially parallel to the base material plane, wherein each of the plurality of square-shaped holes has a hole length ranging between about 10 millimeters and 25 millimeters and a distance between edges of each adjacent square-shaped hole ranges between about 2 millimeters and 3 millimeters;

a plurality of tabs on the first side and extending therefrom, adjacent to each hole and substantially perpendicular to the base material plane, wherein each tab is triangle shaped and includes:

an inner surface wherein the inner surface is generally directed towards a center of a corresponding hole; and an outer surface wherein the outer surface is generally directed away from the center of the corresponding hole; and a substance disposed on the second side of the base material and the inner surface of each tab but not disposed near the edge of each of the plurality of tabs wherein the substance comprises:

a source of particles wherein the particles are selected from the group consisting of alpha particles and beta particles and wherein the source of particles comprises a source material selected from the group consisting of rare earth metals and rare earth ore; and a bonding matrix material, wherein the bonding matrix material comprises a paint material selected from the group consisting of mineral paint, organic/inorganic compound paint, luminous paint, conductive paint and magnetic paint.

* * * * *